United States Patent [19]

Black

[11] 4,189,243

[45] Feb. 19, 1980

[54] IN-LINE MUD SHEARING APPARATUS

[76] Inventor: Wesley F. Black, 2014 10th Ave., E., Apt. 206, Williston, N. Dak. 58801

[21] Appl. No.: 872,052

[22] Filed: Jan. 25, 1978

[51] Int. Cl.[2] ..... B01F 5/06

[52] U.S. Cl. ..... 366/336; 366/341

[58] Field of Search ..... 366/336, 341, 337, 338, 366/339, 340, 178; 138/38, 42

[56] References Cited

U.S. PATENT DOCUMENTS

| | | | |
|---|---|---|---|
| 2,627,315 | 2/1953 | Hettinger | 166/5 |
| 2,805,043 | 9/1957 | Williams | 255/24 |
| 2,946,565 | 7/1960 | Williams | 255/1.8 |
| 3,077,358 | 2/1963 | Costa | 285/133 |
| 3,147,717 | 9/1964 | Smith | 366/336 |
| 3,198,256 | 8/1965 | Kirby | 166/99 |
| 3,207,484 | 9/1965 | Rubin | 366/336 |
| 3,411,321 | 11/1968 | Schurman | 64/1 |
| 3,775,063 | 11/1973 | Grout | 23/283 |
| 3,789,880 | 2/1974 | Armstrong | 137/625.3 |
| 3,802,537 | 4/1974 | White | 181/36 |
| 3,923,288 | 12/1975 | King | 366/336 |
| 4,043,539 | 8/1977 | Gilmer | 366/341 |

*Primary Examiner*—Robert W. Jenkins
*Attorney, Agent, or Firm*—Young & Martin

[57] ABSTRACT

A mud shearing device for placement in the mud flow line in a well drilling operation includes a series of inner pressure chambers surrounded by concentric outer chambers with jet discharge ports connecting each inner chamber with a respective outer chamber and an inlet aperture connecting each succeeding inner chamber with a preceding outer chamber. The mud flow line is connected to the first inner chamber by a flanged nipple, and mud is pumped under pressure into the first inner chamber and then sheared by discharge in a high velocity jet stream through the discharge ports into the first outer chamber and impinged against the wall surface of the outer chamber. A similar shearing mud flow is repeated through the succeeding series of inner and outer chambers and respective discharge ports to the last outer chamber which is connected by an outlet nipple to a continuation of the mud flow line where the mud continues in a conventional flow circuit in the drilling operation. Removable nozzles of various sizes can be secured in the discharge ports.

11 Claims, 10 Drawing Figures

IN-LINE MUD SHEARING APPARATUS

BACKGROUND OF THE INVENTION

The present invention generally concerns fluid mixing apparatus, and more particularly in-line mud shearing apparatus for thoroughly mixing and dispersing mud particles in a mud fluid medium in well drilling operations.

Mud is a dense fluid mixture comprised essentially of water, fine soil and clay particles, and dispersion and surfactant additives, and it is used in oil and gas well drilling and workover operations to control the reservoir pressure in a well. The head or pressure of the column of fluid in the well bore must exceed the reservoir pressure at the bottom of the well to prevent the well from flowing or possibly blowing out during drilling or workover operations. The fine soil and clay particles mixed with and held in suspension in the water significantly increase the effective weight or head of the column of fluid in the well bore to control wells bored into higher pressure reservoirs. Consenquently, it is essential that the fine soil or clay particles be thoroughly dispersed and held in suspension in the water medium. Chemical additives are available to aid in this regard, but thorough mixing is required, and the mud is kept constantly circulating by pumping it down the drill pipe or tubing to the bottom of the well bore and back out through the annular space between the drill pipe and the side of the well bore both to maintain a uniform mixture of the mud and to carry drilled cuttings and debris out of the well bore.

It is customary to add the fine soil and clay particles and other additives to the water fluid medium to formulate the mud in a pit or mixing tank for that purpose. Then the mixture is mechanically stirred and agitated in the pit or mixing tank by use of mechanical devices or more sophisticated laser or sonar devices in order to achieve a satisfactory mixture and dispersion of the mud particles in the fluid medium. While such devices and methods are successful to some extent in obtaining a uniform mixture and dispersion of the mud particles in the fluid several problems have heretofore remained unsolved. Such devices are expensive, complex, and somewhat inefficient to operate. For example, mechanical and jet type mixers used in the mixing tank or mud pit often cause air entrainment in the mud fluid which not only results in a mud which has less density than desired but which also could result in formation of larger bubbles of entrapped air at critical locations in the mud flow circuit as well as unnecessary turbulence and cavitation. Further, while it is customary to discharge the mud fluid into the well bore through nozzles in the bit at the bottom of the drill pipe to jet cuttings and debris away from the bit and thereby resulting in some shearing of the fluid, the location of such shearing at the most remote portion of the mud flow circuit under high temperature and pressure bottom hole conditions is neither desirable nor thoroughly effective to significantly enhance the mud mixture and dispersion of particles in the fluid medium.

SUMMARY OF THE INVENTION

Accordingly, it is an object of the present invention to provide a new and novel apparatus for shearing drilling mud fluid through a series of jets and sleeves to ensure that the fine soil and clay particles are thoroughly mixed and completely dispersed in the fluid prior to entering the well bore through the drill pipe.

It is also an object of the present invention to provide an effective mud shearing apparatus which has no moving parts and is easily accessible in the mud flow circuit in conventional well drilling operations.

It is another object of the present invention to provide a mud shearing device which is positioned in the mud flow line above the ground where the mud is sheared at a cooler temperature and under lower pressure than it would be at the bottom of the well bore and immediately after being mixed in the mud pit or mixing tank.

It is also an object of the present invention to provide a mud shearing device which produces no entrained air in the mud system, is easily accessible in the system and can be inexpensively manufactured and utilized in various sizes.

It is still a further object of the present invention to provide a mud shearing device in which the extent of shearing and the pressure drop in the system resulting from the shearing of the mud can be adjusted by use of easily accessible interchangeable jet nozzles and which does not include any moving parts.

The apparatus for shearing drilling mud in the mud flow line of a conventional mud flow circuit in a well drilling operation includes a series of inner pressure chambers surrounded by outer gathering chambers, the inner chambers being connected by discharge ports or jet nozzles to the outer chambers. The series of chambers is connected directly in the mud flow line such that the mud is pumped under pressure into the first inner chamber and initially sheared by discharge in high velocity jet streams through a plurality of discharge ports or nozzles into the lower pressure environment of the surrounding outer chamber. The pressure in the inner chamber forces the jet stream of mud to impinge against the wall of the outer chamber causing further shearing and dispersion of mud particles in the fluid medium.

The mud then flows from the first outer chamber into a second inner chamber where it is again sheared by discharge in a high velocity jet stream through discharge ports or nozzles into a second outer chamber where fluid is again impinged against the wall of the second outer chamber. This same process is again repeated through a third inner chamber and pressure discharged in a jet stream through additional discharge ports or nozzles into a third outer chamber where the mud again is impinged against the wall of the third outer chamber. The third outer chamber is connected back into a continuation of the mud flow line where the mud continues its flow to the well bore in the conventional mud flow circuit.

The inner chambers are formed by an elongated cylindrical tube partitioned into three sections arranged in end-to-end relation to one another by axially spaced apart partition plates. A larger cylindrical casing is positioned concentrically around and coextensive with the tube, and is also partitioned into three sections disposed in outer concentric but axially offset relation to the inner sections by annular collars on the external surface of the tube which extend radially outward into contact with the inside surface of the casing. A plurality of discharge ports through the walls of the tube in each chamber provide fluid flow communication between the internal chambers in the tube and the respective compartments within the external casing.

Each chamber in the internal tube is also provided with two enlarged inlet apertures in fluid flow communication with the preceding compartment in the external casing. The first internal compartment in the tube is connected into the flow line of a conventional mud circuit in drilling operations by a flanged nipple and an appropriate conventional high pressure connecting union. The last compartment in the external casing is also connected to a continuation of the flow line by an outlet nipple extending from the rear end of the casing and connected to the flow line with a conventional high pressure connecting union.

The mud enters the first internal chamber under pressure from the pump in the mud circuit and is sheared by discharge in a high velocity jet stream through the outlet ports into the first compartment in the casing and impingement against the casing wall. It then flows downstream in the first compartment to the inlet apertures of the second inner chamber where it is again sheared by discharge in a high velocity jet stream through discharge outlets into the second compartment of the casing and impinged again against the casing wall. The mud then continues downstream and into the inlet apertures of the third inner chamber from where it is once more sheared by discharge in a high velocity jet stream through the discharge ports into the third compartment of the casing and impinged against the casing wall once again. The mud, having now been sheared through discharge ports and impinged against the walls of the casing a plurality of times to thoroughly and uniformly mix and disperse the mud particles in the mud fluid medium, continues to flow out the outlet opening in the rear end of the casing and through the outlet nipple to continue in the flow line to the well bore.

The discharge ports in each inner chamber can be provided with removable nozzles so that the cross-sectional area of the discharge ports can be easily changed to vary the shear performance of the apparatus and to vary the pressure drop through the shearing apparatus.

BRIEF DESCRIPTION OF THE DRAWINGS

Other objects, advantages and capabilities of the present invention will become more apparent as the description proceeds taken in conjunction with the accompanying drawings, in which.

DESCRIPTION OF THE PREFERRED EMBODIMENT

Figure 1:
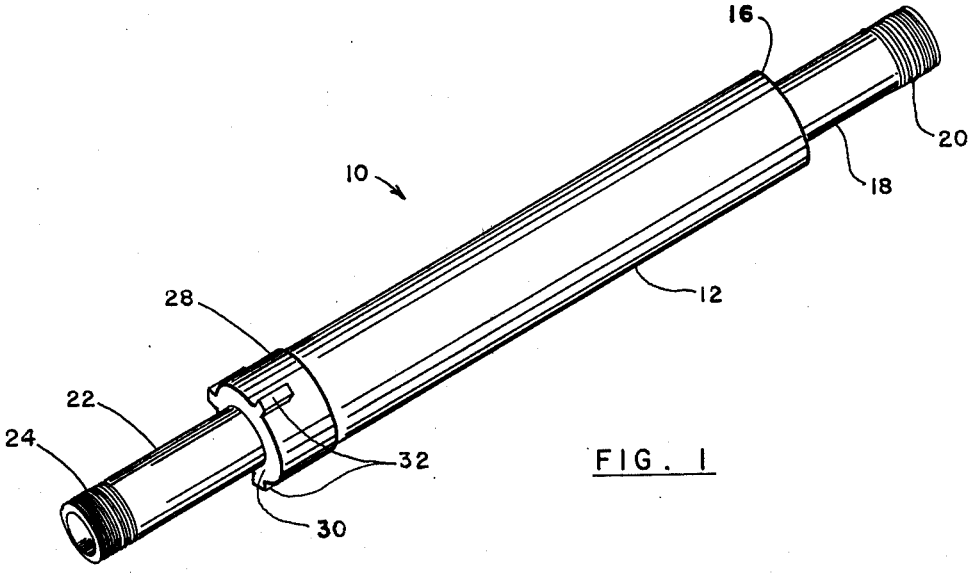
FIG. 1 is a perspective view of the mud shearing apparatus of the present invention.
Figure 2:
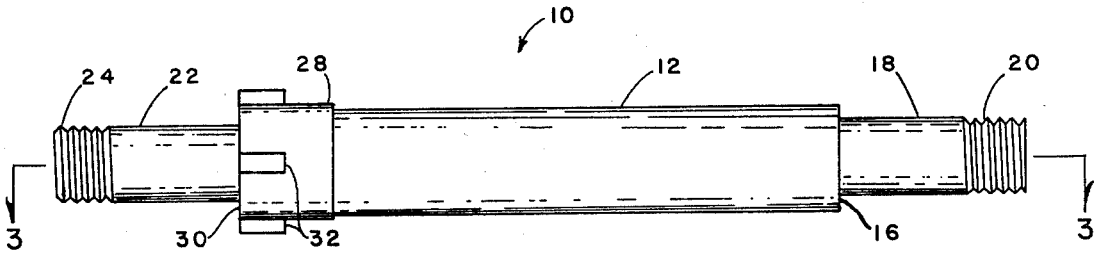
FIG. 2 is a side elevation view of the mud shearing apparatus.
Figure 10:
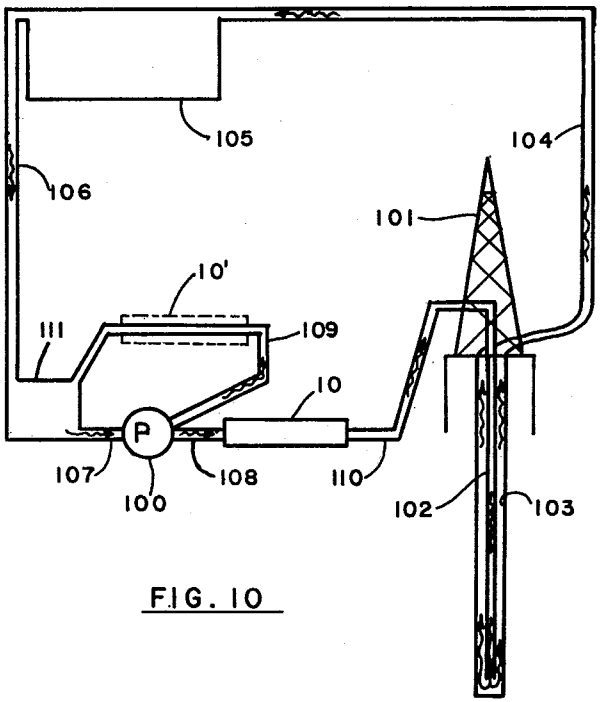
FIG. 10 is a circuit flow diagram of a typical mud flow circuit in a well drilling operation.

The mud shearing device 10 in accordance with the present invention is shown in FIG. 1 in fully assembled form. It will be appreciated from the description that follows that the mud shearing device can be installed as a component portion of a mud flow line in a conventional well drilling operation by connecting the inlet nipple 22 to the mud flow line by a conventional union fastener (not shown) attached to threads 24. The outlet nipple 18 can likewise be connected to a continuation of the mud flow line by a conventional pipe union fastener (not shown) threadedly fastened to the threaded end 20. For example, a conventional mud flow circuit is shown in FIG. 10, including a well drilling derrick 101 positioned over a well bore 103 being drilled into the earth by drill pipe 102. Mud fluid is initially mixed in a mixing tank or mud pit 111 and pumped to the bottom of the well bore 103 through drill pipe 102. At the bottom of the drill pipe 102 the mud is discharged though the drilling bit and returned to the surface of the ground through the annular space between the sides of the well bore 103 and the drill pipe 102. At the surface of the ground, the mud is drawn off at the casing head of the well and drained through return flow line or ditch 104 into one or more settling pits 105 where the mud is allowed to remain for a time in a relative calm so that cuttings and debris from the bit can settle out of the mud to the bottom of the pit 105. After a sufficient settling time, the cleared mud flows through line or ditch 106 back to the mixing tank 111 where additional fine soil and clay particles may be added and mixed into the mud fluid.

The mud shearing device 10 of the present invention is shown in FIG. 10 in its preferred location in the mud flow line. The discharge line 108 from the pump 100 is connected to the forward end of the shearing device 10, and the rear end of the shearing device is connected to a continuation of the flow line 110 as it leads to the drill pipe 102.

An alternative position for the shearing device is shown in FIG. 10 in broken lines and indicated at 10' in the mixing line 109. Such a mixing line 109 is sometimes used to continuously circulate a portion of the mud fluid from the mixing tank 111 through the suction line 107 into pump 100 and then discharge it back through mixing line 109 into the mixing tank 111. This mixing cycle continues independently as the mud is also pumped through its conventional mud circuit through the well bore as described above. When such a mixing circuit is used, the shearing device 10' can be installed in the mixing line 109; however, its preferred position is in the flow line as indicated at 10 and described above.

Referring to FIGS. 2 through 5, the shear device 10 is comprised of an elongated cylindrical tube 34 positioned concentrically within a larger elongated cylindrical casing 12. The tube 34 is divided into three chambers 36, 38, 40 by solid partitions 37, 39, 41, respectively. The partition plate 41 at the rear end of chamber 40 defines the rear end of the tube 34 and is spaced a small distance axially inward from the rear end 16 of the casing 12. The forward end 35 of tube 34 is open and forms the inlet into the tube 34. The annular space between the tube 34 and the inside surface 13 of casing 12 is divided into three separate annular compartments 61, 63, 65 by axially spaced apart annular collars 52, 54, 56 extending radially outward from the tube 34 into contact with the inside surface 13 of casing 12.

The rear end of the casing 12 is defined by an annular shoulder 16 extending radially inward to an outlet nipple 18 attached thereto and extending axially outward from the rear end of the casing 12. The tube 34 is maintained in proper position within the casing 12 by the annular collars 52, 54, 56 in contact with the inside surface 13 of the casing 12 and by a pair of lugs 70, 72 extending from the rear end of the tube into abutting contact with the annular shoulder 16 at the rear end of the casing 12.

The forward end of the shearing device 10 is equipped with a flanged nipple 22 having an annular flange 26 in abutting contact with the forward end 35 of tube 34 and extending radially outward into contact with the inside surface 13 at the forward end of casing 12. An internally threaded flange nut 28 having an annular, radially inwardly extending shoulder 30 is screwed onto the threaded forward end 14 of casing 12 until the shoulder 30 on the flange nut 28 is tight against the flange 26 of the nipple 22 holding the nipple 22 in snug abutting contact with the forward end 35 of tube 34. As thus assembled, the tube 34 and casing 12 are maintained in immovable, concentric relation to each other; however, it can be appreciated that the shearing device 10 can be easily disassembled by merely removing the flange nut 14 and sliding the tube 34 out of the forward end of the casing 12. The flange nut 28 is equipped with cleats 32 on its external surface to accommodate tools for tightening flange nut onto the casing 12 and for loosening and removing it from the casing 12.

The first chamber 36 in tube 34 has a plurality of discharge ports 60 through its walls in flow communication with the first annular compartment 61 in the casing 12. Likewise, the second chamber 38 has a plurality of discharge ports 62 through its walls in communication with the second annular compartment 63, and the third chamber 40 has a plurality of discharge ports 64 through its walls in flow communication with the third annular compartment 65 in the casing 12.

The first annular compartment 61 is also in fluid flow communication with the second inner chamber 38 through enlarged inlet apertures 44, 46 in the wall of chamber 38. Likewise, the second annular compartment 63 is also in fluid flow communication with the third inner chamber 40 through enlarged inlet apertures 48, 50 in the wall of the chamber 40.

Figure 3:
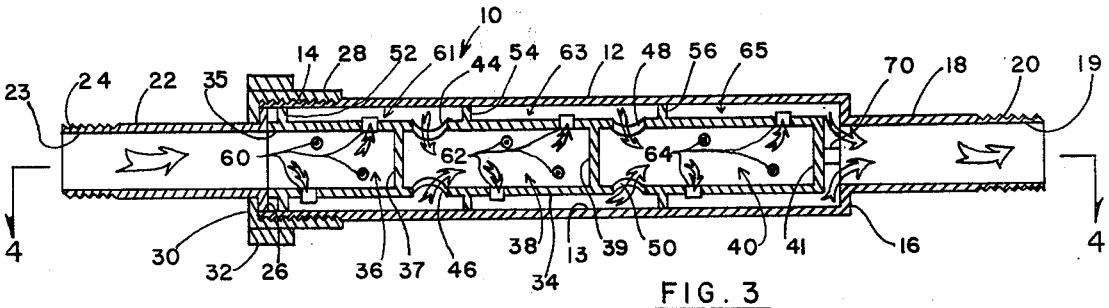
FIG. 3 is a cross-sectional view of the mud shearing apparatus taken along the lines 3—3 of FIG. 2.
Figure 4:
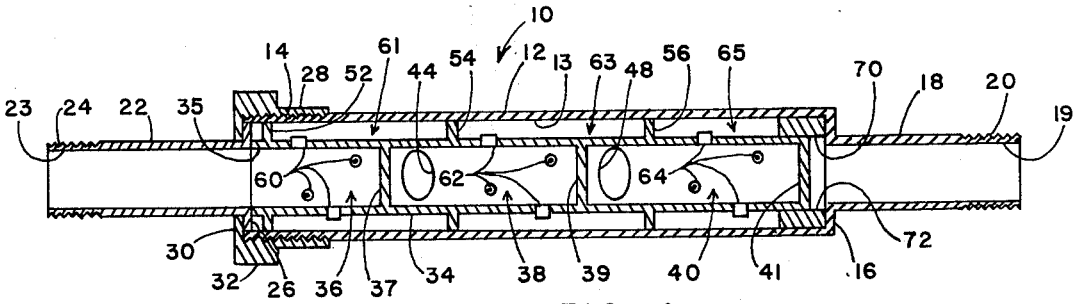
FIG. 4 is another cross-sectional view of the mud shearing apparatus taken along the lines 4—4 of FIG. 3.
Figure 5:
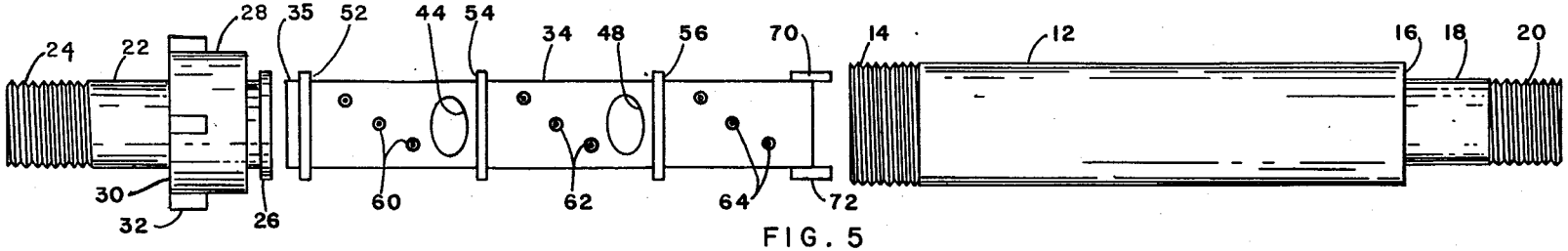
FIG. 5 is an exploded side elevational view of the mud shearing apparatus in disassembled condition.

The total combined cross-sectional area of the discharge ports in each inner chamber is significantly smaller than the area of the inlet opening of each chamber. Therefore, when the mud fluid is pumped under pressure into each chamber, it will be discharged from each chamber through the respective discharge ports in high velocity jet streams escaping into the lower pressure areas of the respective annular compartments in the casing. For example, when the forward end of the shearing device 10 is connected to the discharge pipe 108 of pump 100, as described above, the mud is pumped at a high pressure through the inside 23 of nipple 22 into the first inner chamber 36 of tube 34. The mud flow, as indicated by the flow arrows in FIG. 3, is then forced under pressure through the discharge ports 60 in high velocity, small cross-sectional area jet streams into the lower pressure area of the annular compartment 61 in the casing 12. The high velocity jet streams escaping from the inner chamber 36 through the discharge ports 60 impinge with considerable force against the inside surface 13 of casing 12, thereby causing considerable shearing of the fluid as it is forced through the discharge ports and as it impinges against the inside surface 13 of the casing 12. This severe shearing of the mud fluid causes the mud particles to be separated from each other and mixed and dispersed in the fluid medium of the mud much more thoroughly and uniformly than the initial mechanical mixing which takes place in the mixing tank 111 as described above.

This shearing process is repeated again through the second and third sets of inner chambers and annular compartments in the shearing device to even more completely and thoroughly mix and disperse the mud particles in the mud fluid medium. Referring again to the flow arrows in FIG. 3, the mud in annular compartment 61 flows into the second inner chamber 38 through enlarged inlet apertures 44, 46. The apertures 44, 46 are large enough to accomodate substantially unrestricted flow of the mud from annular compartment 61 into chamber 38 with no significant pressure drop. Therefore, the pressure in inner chamber 38 should be substantially the same as the pressure in annular compartment 61, that pressure being somewhat less than the pressure in the first inner chamber 36. The mud is then again sheared and discharged in high velocity, small cross-sectional area jet streams through the discharge ports 62 into the annular compartment 63 where the jet streams of fluid again impinge with great force against the inside surface 13 of casing 12. Again, the restricted flow of fluid from the discharge port 62 results in a lower pressure in annular compartment 63 than in inner chamber 62. The mud then flows from annular compartment 63 through enlarged inlet apertures 48, 50 into the third inner chamber 40. The mud is severly sheared a third time by high velocity, small cross-sectional area jet stream discharge into the third annular compartment 65 where it is again impinged against the inside surface 13 of casing 12. Again, the pressure in annular compartment 65 is somewhat less than the pressure in inner chamber 40.

From the annular compartment 65, the mud flows around lugs 70, 72 out the rear end of the casing 12 and through the inside 19 of outlet nipple 18. As described above, the outlet nipple 18 is connected to the continuation of the flow line 110 so that the mud continues in the conventional mud flow circuit for drilling operations.

Since the pressure and velocity of the mud being sheared through small cross-sectional area discharge ports and forceably impinged against the inside surface 13 of casing 12 is very high, erosion of the component parts in those areas could eventually occur. Therefore, it is preferable and may be necessary to provide the inside 13 of casing 12 with a tungsten carbide layer or other hard surfacing material. The tube 34 should also be either steel or tungsten carbide coated.

Figure 6:
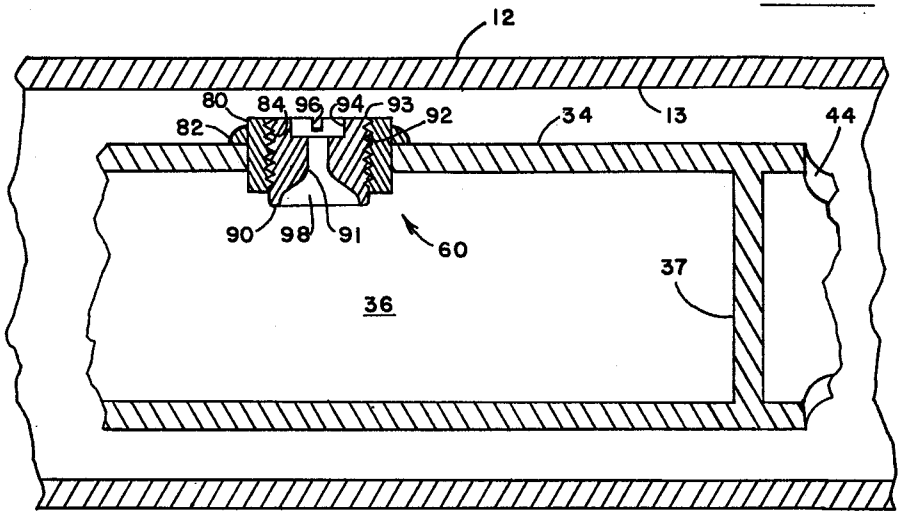
FIG. 6 is an enlarged fragmentary sectional view showing a nozzle positioned in the discharge port of the inner chamber and its relation to the outer casing.
Figure 9:
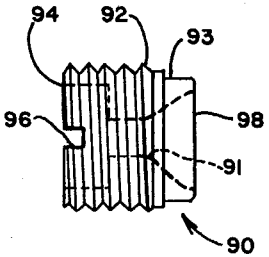
FIG. 9 is a side elevation view of the nozzle.
Figure 8:
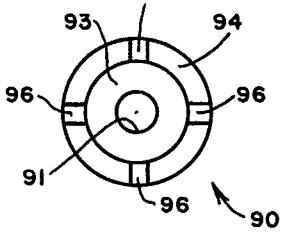
FIG. 8 is a front elevation view of the nozzle.
Figure 7:
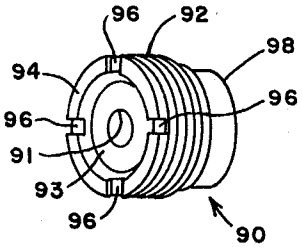
FIG. 7 is a perspective view of a typical nozzle when not installed in the discharge port.

It is also preferable that the discharge ports be equipped with removable and replaceable tungsten carbide nozzles 90, such as those shown in FIGS. 6–9. A discharge port 60 in inner chamber 36, as shown in the enlarged cross-section in FIG. 6, is formed with an internally threaded sleeve 80 positioned transversely through the wall of tube 34 and welded in that position as indicated at 82. The removable nozzle 90 has a body portion 93 with a throat 91 extending axially therethrough. It is externally threaded, as indicated at 92, for screwing into the internal threads 84 of the sleeve 80. The discharge end of the nozzle 90 has an annular collar 94 extending outwardly from the threaded portion 92 of the body 93 and includes a plurality of notches 96 to accomodate tools for tightening the nozzle 90 into the sleeve 80 and to assist in removing the nozzle. The inlet and 98 of the nozzle is somewhat enlarged in comparison to the throat 91.

Nozzles having varying throat sizes can be used, and the nozzles can be conveniently removed and replaced with other nozzles by removing the tube 34 from the casing 12 as described above and simply screwing the nozzle 90 out of the sleeve 80. Such perameters as allowable pressure drop, required volumetric flow, and desired shearing characteristics may be significant in determining the throat sizes of the nozzles to be used in a particular application or drilling operation.

For purposes of description and not of limitation, the casing 12 can be about 5 feet long and fabricated of 7-inch diameter, 26-pound well casing. The tube 34 can be construced or 4-inch diameter well tubing or Schedule 80 line pipe. Each inner chamber 36, 38, 40 can be provided with six discharge ports distributed throughout the wall of the chamber, and each port can be equipped with nozzles having approximately ½-inch or 9/16ths-inch throat.

The inlet and outlet nipples 22, 18 can be approximately 1½ feet long and fabricated of 4-inch diameter line pipe with conventional line pipe threads on the ends.

Although the present invention has been described with a certain degree of particularity, it is understood that the present disclosure has been made by way of example and that changes in details of structure may be made without departing from the spirit thereof.

What is claimed is:

1. Fluid mixing and shearing apparatus comprising:

an elongated tube with one end open and the opposite end closed and being divided into a plurality of chambers by a plurality of partition plates axially spaced apart from each other within said tube, each of said chambers having an enlarged inlet opening and a discharge port in its respective wall section of said tube, said one open end of said tube being the inlet opening of the first chamber, and the subsequent chambers having enlarged apertures in the walls of the respective tube sections for each chamber, said apertures being the inlet openings in said subsequent chambers; and an elongated casing positioned in radially outward spaced concentric relation around said tube, one end of said casing being sealed to the outer peripheral surface of said tube and the opposite end being open to fluid flow and forming an outlet opening.

2. The fluid mixing and shearing apparatus of claim 1, wherein said discharge port in each of said chambers is spaced axially downstream from said inlet opening in each chamber, and including a plurality of partition collars around the outside peripheral surface of said tube axially spaced apart from each other and extending radially outward toward the internal surface of said casing, respective ones of said partition collars being located axially between the inlet opening and outlet port of each of said chambers to interrupt axial flow of fluid in the annular space between said tube and said casing.

3. The fluid mixing and shearing apparatus of claim 2, wherein said partition flanges extend radially outward from said tube into contact with said casing to effectively close off the axial flow of fluid in the annular space between said casing and said tube forcing the flow to be diverted into the inlet opening of the respective chamber.

4. The fluid mixing and shearing apparatus of claim 3, wherein the cross-sectional area of said discharge ports in each of said chambers is smaller than the cross-sectional area of said inlet openings such that a fluid that enters each chamber under pressure is sheared through the discharge port and discharged in a jet steam, and the radial distance between said casing and saib tube is close enough such that the jet stream from each outlet port impinges against the inside surface of said casing.

5. The fluid mixing and shearing apparatus of claim 4, wherein said casing is longer than said tube and terminates at its downstream end in an annular shoulder extending radially inward from the casing wall to an outlet opening of smaller diameter than the diameter of said casing, and said tube includes a lug extending from its downstream end into abuttment against said annular shoulder to maintain a space between the downstream end of said tube and the downstream end of said casing while allowing fluid flow from the annular space between said casing and said tube out through said outlet opening.

6. The fluid mixing and shearing apparatus of claim 5, including an elongated outlet nipple, one end of which is connected to said out-let opening and the other end of which is threaded to receive a pipe connection union.

7. The fluid mixing and shearing apparatus of claim 6, including an elongated inlet nipple, one end of which is threaded to receive a pipe connection union and the other end of which terminates with an enlarged annular connection flange extending radially outward from said other end of said inlet nipple, said other end of said inlet nipple being positioned in axially aligned abutting contact with said one end of said tube, and a flange nut threadedly received onto said one end of said casing having an annular end shoulder extending radially inward toward said inlet nipple, said annular end shoulder of said flange nut being in snug axial contact with said flange on said inlet nipple to retain said inlet nipple in snug abutting contact with said one end of said tube.

8. The fluid mixing and shearing apparatus of claim 4, including a plurality of discharge ports in each of said chambers positioned in spaced apart relation to each other in the wall of said tube to distribute the jet discharge streams uniformly about the annular space between said casing and said tube.

9. The fluid mixing and shearing apparatus of claim 8, including a removable nozzle having a discharge opening of reduced cross-sectional area therethrough and threadedly received and retained in each of said discharge ports.

10. Mixing and shearing apparatus for mixing and dispersion of particles in fluid, comprising:

a high pressure chamber having an inlet opening adapted to allow fluid to be pumped into said high pressure chamber and a discharge opening with a smaller cross-sectional area than the cross-sectional area of said inlet opening adapted to allow fluid under pressure in said high pressure chamber to escape therefrom in a high velocity jet stream; and a low pressure gathering chamber outside said high pressure chamber and in fluid flow communication with said discharge opening and having an outlet opening of larger cross-sectional area than said discharge opening adapted to allow the fluid to flow out of said gathering chamber under lower pressure than the pressure of the fluid in said high pressure chamber, said gathering chamber also having a surface positioned in aligned, spaced apart relation to said discharge opening and adapted to interrupt and break up the high velocity jet stream escaping from said high pressure chamber.

11. The mixing and shearing apparatus of claim 10, wherein said high pressure chamber is an elongated cylindrical tube open at one end and closed at the other end, said inlet opening being said open end, and said discharge opening extending through a sidewall of said tube, and said gathering chamber is an elongated cylindrical casing of larger inside diameter than the outside diameter of said tube and positioned in concentric relation around said tube, said tube having a front spacer attached to and extending radially outward from its one end and a rear spacer attached to and extending radially outward from said other end to retain the spaced concentric relation between said tube and said casing, an elongated nipple with an enlarged annular flange is positioned in abutting relation to said one end of said tube, and a flange nut is threadedly received onto the end of said casing with an annular flange extending radially inward toward said nipple.

* * * * *